US005195883A

United States Patent [19]

Hanna et al.

[11] Patent Number: 5,195,883

[45] Date of Patent: Mar. 23, 1993

[54] FLUE GAS RECIRCULATION SYSTEM WITH FRESH AIR PURGE FOR BURNERS

[75] Inventors: Terrance B. Hanna; Robert K. Black, both of Monroe, Wis.

[73] Assignee: Aqua-Chem, Inc., Milwaukee, Wis.

[21] Appl. No.: 861,468

[22] Filed: Apr. 1, 1992

[51] Int. Cl.[5] ..... F23J 7/00

[52] U.S. Cl. ..... 431/3; 431/30; 431/116; 110/204; 110/234; 126/285 R

[58] Field of Search ..... 431/9, 3, 115, 116, 431/20, 29, 30, 176; 110/204, 205, 206, 345, 344, 234; 126/285 R, 292, 285 B, 101

[56] References Cited

U.S. PATENT DOCUMENTS

| | | | |
|---|---|---|---|
| 3,868,211 | 2/1975 | La Haye et al. | 431/115 |
| 4,439,140 | 3/1984 | Stout | 431/3 |
| 4,487,137 | 12/1984 | Horvat et al. | 431/20 |
| 4,519,733 | 5/1985 | Parish et al. | 431/176 |
| 4,634,369 | 1/1987 | McGill et al. | 431/29 |
| 4,659,305 | 4/1987 | Nelson et al. | 431/9 |
| 4,926,765 | 5/1990 | Dreizler et al. | 110/204 |
| 5,059,114 | 10/1991 | Stout et al. | 431/3 |

OTHER PUBLICATIONS

Industrial Combustion Brochure of 12-90 describing LNDEG 145P Firing a Kewanee L3S 300 HP Boiler.

Industrial Combustion Brochure of 10-89 describing LNDEG 145 Firing a Kewanee KPC88 350 HP Boiler.

*Primary Examiner*—James C. Yeung

*Attorney, Agent, or Firm*—Whyte & Hirschboeck S.C.

[57] ABSTRACT

Flue gas is captured from an emissions stack and recirculated to a burner by an induced flue gas recirculation system comprising: a mixing assembly for mixing combustion air and recirculated flue gas into a substantially homogeneous mix; a burner assembly for mixing and combusting the combustible mix with a fuel to produce a flue gas; an injection assembly, connected to and downstream from the mixing assembly and connected to and upstream from the burner assembly, for receiving the combustible mix from the mixing assembly and injecting it with the combustible fuel into the burner assembly; a combustion chamber connected to and downstream of the burner assembly for containing the combustible mix and flue gas; an emissions stack connected to and downstream from the combustion chamber for venting the flue gas from the combustion chamber; recirculating means for recirculating a portion of the flue gas from the emissions stack to the mixing assembly; and a purge assembly connected to the recirculating means for removing the recirculated flue gas from the recirculating means prior to initiating the operation of the burner assembly.

10 Claims, 2 Drawing Sheets

FIG. 1
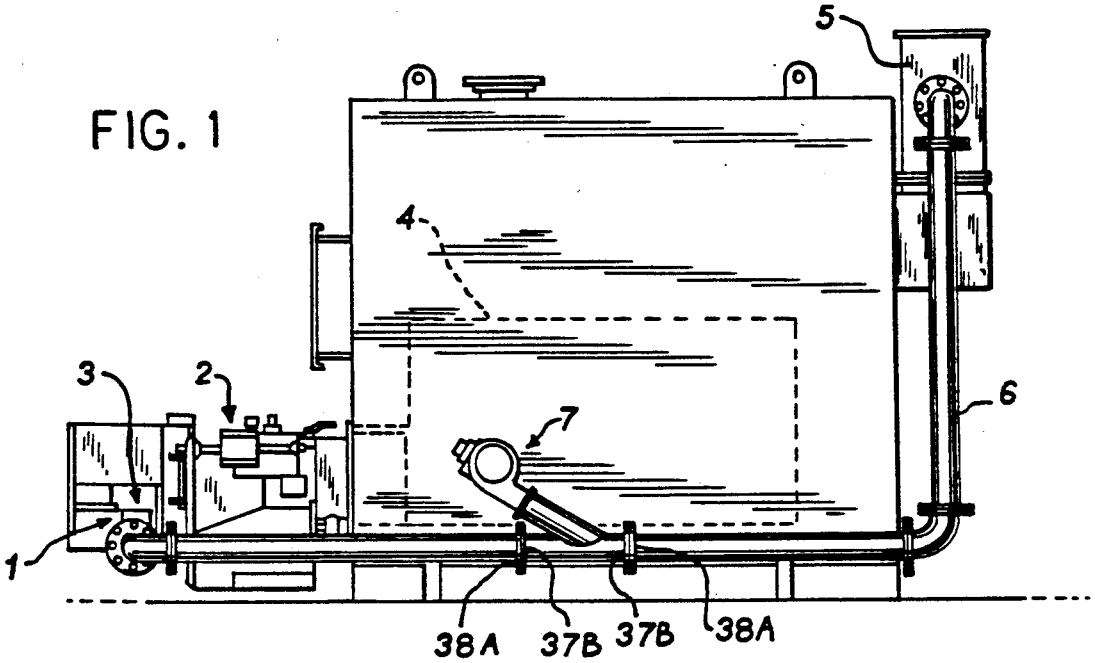
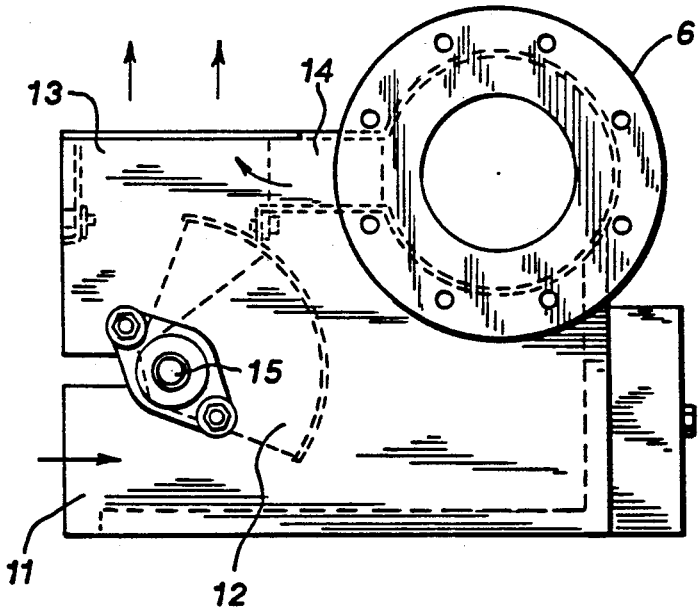
FIG. 2
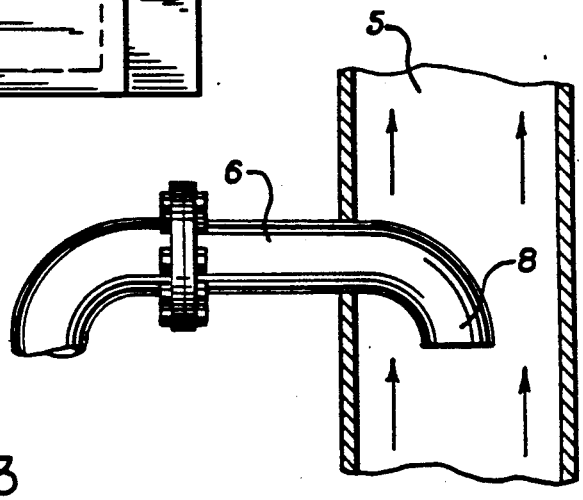
FIG. 3

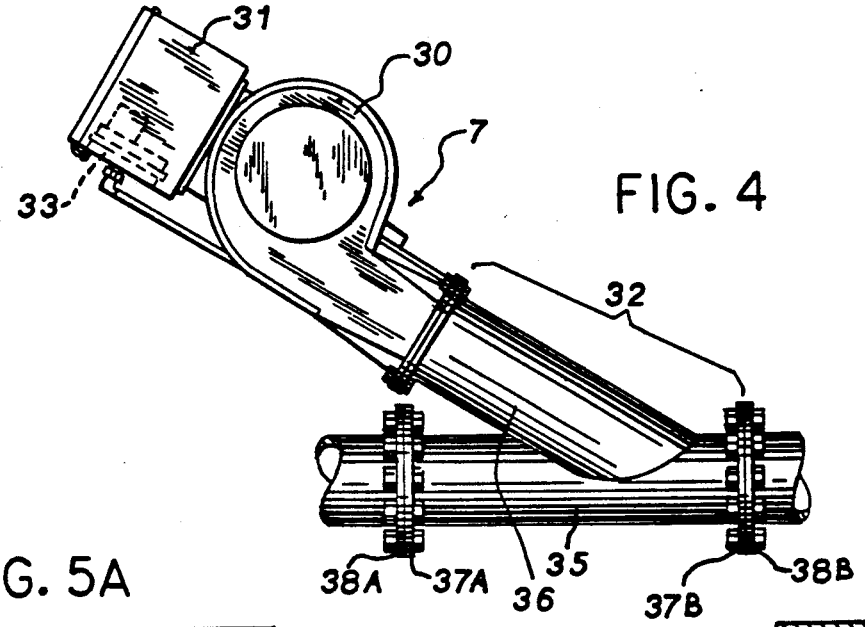
FIG. 4
FIG. 5A
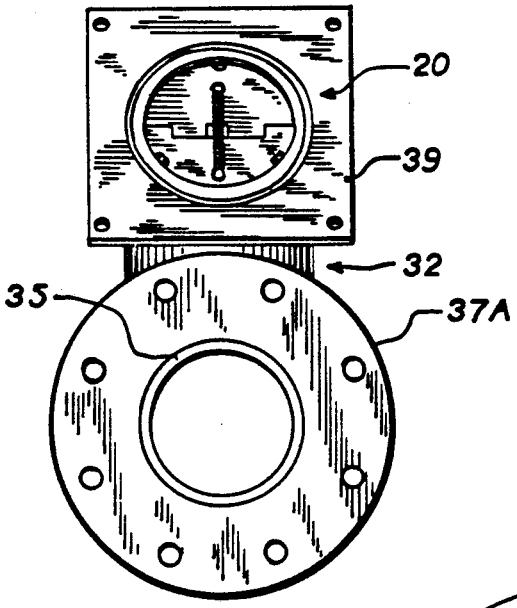
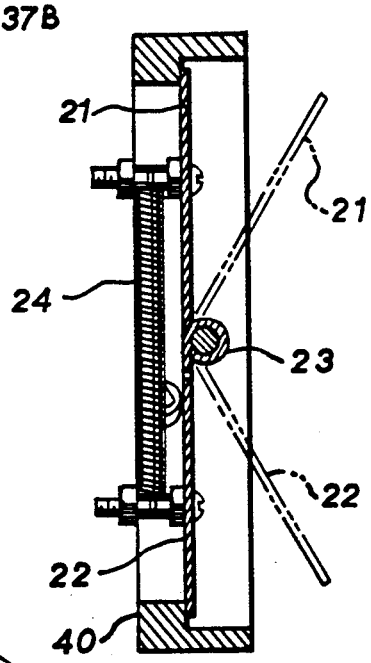
FIG. 5C
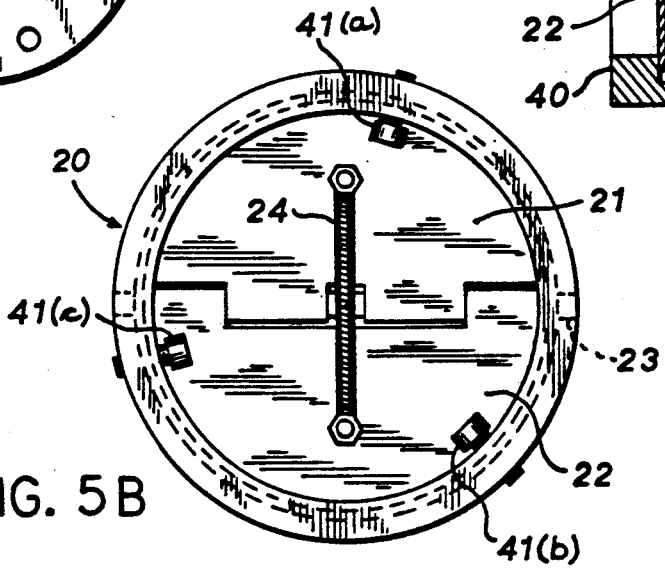
FIG. 5B

FLUE GAS RECIRCULATION SYSTEM WITH FRESH AIR PURGE FOR BURNERS

BACKGROUND OF THE INVENTION

This invention relates to burners. In one aspect, the invention relates to flue gas recirculation (FGR) systems for burners while in another aspect, the invention relates to induced FGR systems for burners. In yet another aspect, the invention relates to induced FGR systems equipped with a fresh air purge apparatus, and the operation of such a system.

FGR systems are known, and U.S. Pat. No. 4,659,305 to Nelson and Rulseh provides a good description of such systems generally, and of forced FGR systems in association with a fire tube boiler, specifically. For example, Nelson and Rulseh describe the formation of nitrogen oxides during combustion, the interest in reducing nitrogen oxides emissions by the recirculation of flue gas, and various FGR systems that were known prior to the date of their invention. They then proceed to describe their invention, i.e. a forced FGR system which recovers a portion of the flue gas from a discharge stack and recirculates it by means of a recirculation fan to a point downstream of the fuel-air mixture in the burner. This results in a cooler flame which in turn substantially reduces the nitrogen oxides content in the boiler stack emissions. The burner assembly itself includes conventional damper and air diffuser systems and a plurality of openings near the inner end of the burner housing, through which the boiler fuel is emitted and mixed with air. Slots are formed at the outlet end of the burner, and are coupled to an annular chamber surrounding the burner. The annular chamber is connected to the recirculation fan by means of a duct.

While the forced FGR system of U.S. Pat. No. 4,659,305 performs admirably, it does require a recirculation fan, it does mix the flue gas with the combustion air downstream of the flue gas/air mixture, and it does use a flow control valve for the dual purposes of controlling the amount of recirculated gas admitted to the FGR system and to insure positive shutoff of gases that flow through the duct leading to the burner. Each of the features impact the overall capital cost and operating efficiency of the FGR system.

If the recirculation fan is eliminated from the FGR system, then the total electrical load needed to operate the system is reduced. In addition, the capital costs associated with acquiring and installing the fan are eliminated.

If the recirculated flue gas and combustion air are introduced prior to the combustion air fan and the burner diffuser, then the combustion air and recirculated flue gas are thoroughly mixed prior to entry into the combustion zone resulting in flame temperatures which are more homogeneous. This means that the number of hot spots and/or excess air pockets in which nitrogen oxides are typically formed are reduced, and this in turn means fewer nitrogen oxides emissions.

The addition of a fresh air purge to the FGR system can eliminate the need for a FGR shutoff valve. Moreover, a fresh air purge can provide an "air lock" which prevents combustible gases from flowing into the burner combustion air fan and combustion chamber from the FGR system until pilot ignition and main flame are safely established. In addition, the air purge motor starter can be electrically interlocked with the burner flame safeguard circuit providing a secondary proof that the FGR piping is safely purged.

These and other modifications to known FGR systems are more fully described below.

SUMMARY OF THE INVENTION

According to this invention, flue gas is captured from an emissions stack and recirculated to a burner assembly by an induced flue gas recirculation system comprising:

a. a mixing assembly for mixing combustion supporting air and a controlled volume of recirculated flue gas into a substantially homogeneous, combustible mix;

b. a burner assembly for mixing and combusting the combustible mix and a combustible fuel to produce flue gas;

c. an injection assembly, connected to and downstream from the mixing assembly and connected to and upstream from the burner assembly, for receiving the combustible mix from the mixing assembly and injecting it with the combustible fuel into the burner assembly;

d. a combustion chamber connected to and downstream of the burner assembly for receiving and containing the combustible mix and flue gas;

e. an emissions stack connected to and downstream from the combustion chamber for venting the flue gas from the combustion chamber;

f. substantially gas-tight recirculating means for capturing and recirculating the controlled volume of flue gas from the emissions stack to the mixing assembly; and g. a purge assembly connected to the recirculating means for purging the recirculating means of flue gas with air prior to initiating the operation of the burner assembly.

The purge assembly is operational prior to initiating the operation of the burner assembly, during pilot trial and main flame ignition and if desired, after the burner flame is extinguished. When operational, the purge assembly provides an airlock preventing combustible gases from flowing into the mixing assembly and combustion chamber from the FGR system. After the main flame of the burner is established, the purge assembly is inactivated and flue gas is continuously recirculated from the emission stack to the burner by way of the FGR piping, FGR metering value, and mixing and injection assemblies.

DESCRIPTION OF THE DRAWINGS

FIG. 1 is a schematic side view of a boiler and a FGR system according to one preferred embodiment of this invention.

FIG. 2 is a detailed elevational view of a mixing assembly according to one preferred embodiment of this invention.

FIG. 3 is a detailed cross-sectional side view of one preferred embodiment of a 90° long radius elbow for capturing flue gas within an emission stack for recycle to a burner.

FIG. 4 is a detailed side view of one preferred embodiment of a purge assembly.

FIG. 5-A is a detailed end view of the Y-shaped piping connection of the purge assembly of FIG. 4.

FIG. 5-B is a detailed view of the damper assembly of the piping connection of FIG. 5-A.

FIG. 5-C is a detailed sectional view of the damper assembly of FIG. 5-B.

Like numerals are used to designate like parts throughout the drawings. Various items of equipment, such as valves, fittings, switches, sensors, etc., have been omitted from the drawings so as to simplify the description of the invention. However, those skilled in the art will realize that such conventional equipment can be, and are, employed as desired.

DETAILED DESCRIPTION OF THE PREFERRED EMBODIMENT

In FIG. 1, mixing assembly 1 is connected to and upstream from injection assembly 3. Burner assembly 2 is connected to and downstream from injection assembly 3, and is connected to and upstream of combustion chamber 4. Emissions stack 5 is connected to and downstream of combustion chamber 4, and is connected to mixing assembly 1 by piping 6. Purge assembly 7 is attached to piping 6 at any convenient location along its length. Each of these assemblies and pieces of equipment are in open communication with the assemblies and/or equipment to which they are connected, thus allowing (when in operation) the free passage of fuel and combustion supporting air through the mixer and injection assemblies into the burner assembly where the mixture is combusted to flue gas, and the passage of the flue gas through the combustion chamber into the emissions stack in which a portion of the flue gas is captured and recirculated through piping 6 back to mixer assembly 1.

Mixer assembly 1 can be of any design and construction that results in the effective mixing of recirculated flue gas and combustion air to form a substantially homogeneous, combustible mix. One preferred embodiment of the mixing assembly is shown in FIG. 2. Combustion air enters a combustion air inlet 11, past a combustion air damper 12, and into a mixing chamber 13. Recirculated flue gas from piping 6 enters mixing chamber 13 by way of FGR inlet 14. Within mixing chamber 13, the combustion air and recirculated flue gas are mixed with one another and the mixture is drawn toward the burner assembly by the suction created from the operation of the injection assembly. The amount of combustion air and recirculated flue gas entering mixing chamber 13 is regulated, in part, by the force of the draw or suction created by the injection assembly. The extent of mixing between the combustion air and recirculated flue gas that occurs in mixing chamber 13 is also regulated by the force of the draw created by the injection assembly, and this mixture is further homogenized as it passes through the assembly into burner assembly 2.

Injection assembly 3, typically a combustion air fan, is designed and constructed such that it not only creates a draw or suction of sufficient force across both combustion air inlet 11 and piping 6 to deliver a combustible mixture to burner assembly 2, but also that it delivers the combustible mixture in a manner that allows it to be intimately mixed with a combustible fuel within burner assembly 2. These injection assemblies or fans are well known in the art, and it is sized consistent with the requirements of the burner assembly.

The design and construction of the burner assembly is not critical to this invention, and the burners described in U.S. Pat. Nos. 4,659,305 and 4,519,733 are typical of those used in this invention. These burners can combust gaseous, liquid or both types of fuel, e.g., natural gas, fuel oil No. 2, etc., and are designed to thoroughly mix the fuel and combustible mix, i.e. combustion supporting air and recirculated flue gas, prior to their ignition.

Combustion chamber 4 can be virtually of any construction and includes scotch or fire box fire tube boilers, cast iron boilers, water tube boilers, air heaters, dryers and any other device that may require heat derived from the combustion of hydrocarbon products or derivatives of hydrocarbon products. Heat generated from the combustion of the fuel, recirculated flue gas and combustion supporting air is transferred within the combustion chamber to water or other heat absorbing media, and the remaining combustion products comprise the flue gas which is vented from the combustion chamber by way of at least one emissions stack.

The flue gas comprises the typical combustion products of water vapor, carbon oxides, and nitrogen oxides, and the emissions of the later are the subject of extensive emissions regulations. As such, the flue gas containing nitrogen oxides are desirably captured within the emissions stack and recirculated to the burner assembly to cool the flame. One preferred means of capturing a portion of the flue gas within emissions stack 5 is by the use of a 90° long radius elbow (#8 in FIG. 3) which is connected to and is in open communication with piping 6. The velocity pressure of the flue gas exiting up emissions stack 5, particularly at mid to high fire operation of the boiler, fills and pressurizes elbow 8 resulting in a greater flow of flue gas through piping 6 than that which would be otherwise achieved from the draw of the injection assembly alone. In addition, a valve (not shown) is mounted anywhere along the length of pipe 6 or on mixing assembly 1, preferably as near or on the mixing assembly as practically possible, to control the volume of flue gas admitted to the flue gas recirculation means. The valve is operated by electrical, pneumatic or mechanical means, and it is operated in such a manner as to deliver a volume of flue gas to the mixing assembly that is consistent with the desired firing rate of the burner or in other words, the valve is controlled by the demands of the burner.

Purge assembly 7, one embodiment of which is shown in FIG. 4, comprises a fan 30, a motor 31 to operate fan 30, a piping connection 32 to connect the assembly to piping 6, and an electrical air pressure switch 33. This assembly connects to piping 6 anywhere along its length in a manner that when in operation, fresh air is injected into piping 6 to push any recirculated flue gas upstream of the purge assembly toward and into emissions stack 5. Piping connection 32 is a Y-shaped pipe formed of trunk 35 and branch 36. Piping connection 32 can be of one or two piece construction, and branch 36 can join with trunk 35 anywhere along the length of trunk 35. The branch is in open communication with the trunk.

Trunk 35 is typically a straight section of pipe open at both ends and designed and sized such that when connected in any conventional manner to piping 6, e.g. fastening flange plates 37-A and 37-B to reciprocal flange plates 38-A and 38-B of piping 6 (shown in FIG. 1), it forms an integral, gas-tight section of piping 6.

While one end of branch 35 is joined in open communication with trunk 35, the other end is equipped with a damper assembly 20 and is designed and sized to mate in a gas-tight relationship with fan 30, e.g. by means of flange plate 39 (FIG. 5-A). Damper assembly 20 is mounted into branch 36 anywhere along its length by the action of allen set screws 41(*a*), (*b*) and (*c*) against the internal wall of branch 36. This mounting need not be gas-tight in as much as any leak during operation leaks into piping 6 due to the negative pressure that results from the induced flow method of operation.

Damper assembly 20 (FIGS. 5-B and 5-C) comprises upper blade 21 and lower blade 22, both attached to rod 23 and spring 24. When in operation, the force of the fresh air against blades 21 and 22 is sufficient to cause each to pivot about rod 23 in a manner that each closes upon the other, and this in turn causes each end of spring 9 to flex toward one another. This action creates an open communication between fan 30 and piping 6 such that fresh air can move from the former into the latter. When not in operation, spring 9 is in an unflexed state and thus pulls the faces of blades 21 and 22 apart from one another such that the blades close the open communication between fan 30 and piping 6. Preferably, the damper assembly is designed such that the blades can only close upon one another in the direction of piping 6, and this is easily accomplished by including a collar as part of the design of the damper assembly such that the blades are in contact with it when they are in a position that closes the communication between fan 30 and piping 6. This feature is shown in FIG. 5c as item 40, and it can be an insert mechanically or adhesively fixed to branch 36, or simply a milled recess of the inner wall of branch 36.

In operation, an operating control switch (not shown) closes and starts fan 30. The fan creates sufficient air pressure to open the purge damper assembly (i.e. force the opposing faces of upper and lower blades 21 and 22 toward one another), and forces fresh air into FGR piping 6. The capacity of the purge assembly fan is sufficient to pressurize the FGR piping, and this in turn closes electrical FGR purge assembly air pressure switch 33.

Since the FGR piping is pressurized with fresh air, it is purged toward and into the emissions stack. In addition, fresh air is drawn toward the combustion air damper (#12 in FIG. 2). This flooding of the FGR piping provides positive flushing with fresh air, and an air lock preventing combustible gases from flowing into the injection assembly, e.g. combustion air fan, and combustion chamber from the FGR piping until pilot ignition and the main flame are safely established. In addition, the motor starter (not shown) of the purge assembly is electrically interlocked with the burner flame safeguard circuit (not shown) providing a secondary proof that the FGR piping has been safely purged.

Fan 30 of the purge assembly continues to run during burner pre-purge, pilot trial and main flame ignition. This fan can also be operated to flood the FGR piping with fresh air after the main flame has been extinguished.

After the main flame has been established, fan 30 is stopped and since the pressure against the blades of the purge damper assembly is decreased, spring 24 returns to its unflexed state and the communication between fan 30 (and thus the atmosphere) and piping 6 is closed. Because of the design of the purge damper assembly, the blades will open during the purge regimen, but not as a result of the induced negative pressure that exists during the normal burner operation. The air pressure against the blades from fan 30 and motor 31 is much greater than the induced negative pressure from the combustion air fan allowing spring 24 to hold blades 21 & 22 closed against collar 40.

The amount of recirculated flue gas returned to the burner is metered proportionately with the burner firing rate. This is accomplished with a FGR metering valve, also known as a butterfly control valve (not shown), which is connected directly to the burner firing motor. Alternatively, the FGR metering valve can be driven by a separate motor which would be electronically linked to the burner firing rate, rather than mechanically. Characterized cam trim can also be provided to control precisely the FGR valve position.

The recycled flue gas flow is induced by the injection assembly, e.g. the combustion air fan. This means that the suction or draw of the fan is one of the forces that contributes to the capture and recirculation of the flue gas from the emissions stack back to the burner. This has several advantages. First, the recirculated flue gas and combustion air are thoroughly mixed as they flow through the combustion air fan and burner diffuser (not shown) prior to being ignited by the burner and combusted within the combustion chamber.

Second, the relatively homogeneous mixture of recirculated flue gas and combustion supporting air reduces the high temperatures of the stoichiometric zones and increases the temperature of the high excess air zones in the flame, resulting in greatly reduced variations from the overall average flame temperature. This in turn reduces the areas within the main flame in which nitrogen oxides are formed, and thus reduces the amount of the nitrogen oxides that are vented from the combustion chamber through the emissions stack.

Third, more complete mixing of the fuel, combustion air and recycled flue gas is provided due to the greater mass flow through the burner diffuser.

The outlet (not shown) of the FGR metering valve is connected to the purge damper assembly and the mixing assembly. The connections from the combustion chamber through the emissions stack and piping, to the combustion air damper connection are essentially gas tight. Since the entry of the recirculated flue gas is between the combustion air damper opening and the combustion air fan inlet, maximum draw or suction is provided at low to mid-range firing rates. To supplement this suction at mid to high fire rates, a 90° long radius elbow (#8 in FIG. 3 and which is connected to and is in open communication with piping 6) is inserted in emissions stack 5. The velocity pressure of the exiting flue gas up the emissions stack at mid to high fire rate pressurizes the elbow, and thus produces a greater flow of recycled flue gas through piping 6.

The total electric motor load for the induced FGR system of this invention, as compared to a pressurized FGR system, is 25–30% less. This comparison assumes that both the induced and forced systems are at an equal firing rate, and providing the same reduction in nitrogen oxides level.

Fail-safe operation of the FGR system of this invention is insured by several safety interlocks. One such interlock is a blast-tube, high temperature switch (not shown) that protects internal burner components against possible high temperature conditions. In addition, the switch also protects against FGR metering valve linkage failure or possible FGR misadjustment.

Another safety interlock is a vessel stack temperature switch (not shown) that holds the burner in a low fire until the combustion chamber is properly warmed. This not only prevents possible thermal shock to the chamber, but also prevents an abnormal mass flow of a lower temperature/higher density flue gas.

Although this invention has been described in considerable detail through one preferred embodiment, this detail is for the purpose of illustration only. Many variations and modifications can be made by one skilled in the art without departing from the spirit and scope of the invention as described in the following claims.

What is claimed is:

1. An induced flue gas recirculation system comprising:

a. a mixing assembly for mixing combustion air and a controlled volume of recirculated flue gas into a substantially homogeneous, combustible mix;

b. a burner assembly for mixing and combusting the combustible mix and a combustible fuel to produce flue gas;

c. an injection assembly, connected to and downstream from the mixing assembly and connected to and upstream from the burner, for receiving the combustible mix from the mixing assembly and injecting it with the combustible fuel into the burner assembly;

d. a combustion chamber connected to and downstream of the burner assembly for receiving and containing the combustible mix and flue gas;

e. an emissions stack connected to and downstream from the combustion chamber for venting the flue gas from the combustion chamber;

f. substantially gas-tight recirculating means for capturing and recirculating the volume of flue gas from the emissions stack to the mixing assembly; and g. a purge assembly connected to the recirculating means for purging the recirculating means of flue gas with air prior to initiating the operation of the burner assembly.

2. The recirculation system of claim 1 in which the mixing assembly comprises:

A. a mixing chamber in which the combustion air and the controlled volume of recirculated flue gas are mixed, B. an inlet for admitting the combustion air to the mixing chamber;

C. an inlet for admitting the controlled volume of recirculated flue gas to the mixing chamber, and D. an outlet through which the mixed combustion air and recirculated flue gas are removed from the mixing chamber.

3. The recirculating system of claim 2 in which the inlet for admitting the combustion air is equipped with a damper for regulating the flow of combustion air into the mixing chamber.

4. The recirculation system of claim 3 in which the recirculating means includes an elbow positioned within the emissions stack for capturing the controlled volume of flue gas, and a valve for controlling the size of the volume of the flue gas captured.

5. The recirculation system of claim 4 in which the purge assembly comprises a motorized fan in communication with a piping connection.

6. The recirculation system of claim 5 in which the piping connection is a Y-shaped pipe comprising a trunk pipe in open communication with a branch pipe.

7. The recirculation system of claim 6 in which the branch pipe is equipped with a damper assembly which regulates the flow of air from the fan into the recirculation means.

8. The recirculation system of claim 7 in which the damper assembly comprises two blades pivotally attached to one another by a connecting rod and spring in such a manner that when the spring is unflexed, the blades are edge to edge and close the communication between the fan and the recirculation means, and when the spring is flexed, the blades close toward one another thereby opening the communication between the fan and the recirculating means.

9. The recirculation system of claim 8 in which the elbow is a 90° long radius elbow.

10. A method of purging an induced flue gas recirculation system, the system comprising:

A. a mixing assembly;

B. a burner assembly;

C. an injection assembly, connected to and downstream from the mixing assembly and connected to and upstream from the burner assembly;

D. a combustion chamber connected to and downstream of the burner assembly;

E. an emissions stack connected to and downstream from the combustion chamber;

F. recirculating means for recirculating a portion of a flue gas from the emissions stack to the mixing assembly; and G. a purge assembly connected to and in communication with the recirculating means, and comprising:

i. a motorized fan for creating a flow of air for delivery into the recirculation means, the fan in communication with a piping connection that in turn is connected to and in communication with the recirculating means; and ii. a damper assembly positioned within the piping connection for regulating the flow of air from the fan to the recirculating means;

the method comprising generating a sufficient flow of air by the fan to open the damper assembly and flow through the piping connection into the recirculation means such that flue gas present in the recirculating means is flushed towards the emission stack thereby forming a positive airlock substantially void of flue gas between the mixing assembly and the emission stack.

* * * * *